United States Patent [19]

Moriya et al.

[11] Patent Number: 4,803,311

[45] Date of Patent: Feb. 7, 1989

[54] SUSPENSION INSULATOR

[75] Inventors: Tsutomu Moriya, Chita; Hiroshi Nozaki, Nagoya, both of Japan

[73] Assignee: NGK Insulators, Ltd., Nagoya, Japan

[21] Appl. No.: 147,999

[22] Filed: Jan. 25, 1988

[30] Foreign Application Priority Data

Feb. 4, 1987 [JP] Japan ..... 62-24214

[51] Int. Cl.[4] ..... H01B 17/08

[52] U.S. Cl. ..... 174/182; 174/196

[58] Field of Search ..... 174/182, 189, 196

[56] References Cited

U.S. PATENT DOCUMENTS 1,284,975 11/1918 Austin ..... 174/196 X 2,443,436 6/1948 Taylor ..... 174/196

OTHER PUBLICATIONS

Ohio Brass Insulator and Electrical Equipment Catalog No. 28, published by Ohio Brass Co., Mansfield, Ohio, copyright 1953, pp. 6 and 41–43 relied on.

*Primary Examiner*—Laramie E. Askin

*Attorney, Agent, or Firm*—Parkhurst, Oliff & Berridge

[57] ABSTRACT

A suspension insulator having a porcelain insulating member with a head portion and a shed, a metal cap cemented to the top of the head portion, and a metal pin cemented to the lower end of the head portion at a pin hole formed in the head portion. The pin hole has a closed top and a downward opening, and its inside surface includes a cylindrical surface portion around the opening, a curved top surface and a round corner surface forming a smooth boundary between the cylindrical surface portion and the curved top surface. The cemented part of the inside surface of the hole has sands rigidly deposited thereon over a range from its lower end to a level within ±3 mm of the junction between the cylindrical surface portion and the round corner surface. The cylindrical surface portion has a radius equal to D and the round corner surface has a radius of curvature equal to Y, such that a ratio of Y/D is in the range of 0.3–0.45.

1 Claim, 4 Drawing Sheets

SUSPENSION INSULATOR

BACKGROUND OF THE INVENTION

1. Field of the Invention

This invention relates to a suspension insulator for use in insulator strings to be supported by arms of transmission line towers. More particularly, the invention relates to a suspension insulator with an improved joint between an insulating member of the insulator and a metal pin thereof, so as to improve the electro-mechanical characteristics of the insulators.

2. Description of the Prior Art

Referring to FIG. 5, the porcelain insulating member of a suspension insulator has a shed 1*a* and a head portion 1*c*, and a metal cap 3 is firmly secured to the top of the head portion 1*c* by cement 2. A pin hole 1*d* is formed in the head portion 1*c* with a closed top and a downward opening. The inside surface of the pin hole 1*d* has a cylindrical surface portion S1, a curved top surface S3, and a round corner surface S2 forming a smooth transition from the upper end of the cylindrical surface portion S1 to the periphery of the curved top surface S3. In the sectional half of FIG. 5, the round corner surface S2 represents about one quarter of a circle. In the case of a conventional insulator of FIG. 5, sands 5 are rigidly deposited onto the entire inside surface of the pin hole 1*d*, so that a metal pin 4 can be firmly joined within the hole 1*d* of the head portion 1*c* by cement 2*a*.

The deposition of the sands 5 over the entire inner surface of the pin hole 1*d* provides very strong bondage between the insulating member head portion 1*c* and the metal pin 4. However, such conventional suspension insulator has a shortcoming in that the sands 5, at the round corner surface S2 tend to produce unstable concentration of electric field thereat, resulting in a considerable deterioration of the reliability of electric strength of the insulator. If one greatly reduces that inner surface of the pin hole 1*d* on which the sands 5 are deposited, the instability of electric strength can be eliminated but mechanical stress tends to be concentrated at the upper end portion of the area with the sands 5, and such mechanical stress concentration can cause a considerable reduction of the mechanical strength.

SUMMARY OF THE INVENTION

Therefore, an object of the present invention is to solve the above-mentioned shortcoming of the prior art by providing a suspension insulator with both excellent electric characteristics and excellent mechanical characteristics.

The inventors have carried out a series of theoretical and empirical studies about the effect of the area of sands deposit on the performance characteristics of the suspension insulator. The invention is based on the outcome of such studies.

A preferred embodiment of the suspension insulator according to the invention uses a porcelain insulating member with a head portion and a shed, and cements a metal cap to the top of the head portion. To cement a metal pin to the lower end of the head portion, a pin hole with a downward opening is formed in the head portion of the insulating member. The pin hole has a cylindrical surface portion adjacent the downward opening, a curved top surface facing the opening, and a round corner surface forming a smooth boundary between the cylindrical surface portion and the curved top surface. That area of the inside surface of the pin hole which is to be cemented for holding the metal pin has sands deposited thereon over a range from the lower end of such area to a level not lower than 3 mm below but not higher than 3 mm above the junction between the cylindrical surface portion and the round corner surface.

With the above-mentioned deposit of sands on the inside surface of the pin hole 1*d* according to the invention, the level of electric field concentration at its round corner surface S2 is greatly reduced while ensuring a sufficiently high mechanical strength. Whereby, the reliability of the suspension insulator is improved.

BRIEF DESCRIPTION OF THE DRAWING

For a better understanding of the invention, reference is made to the accompanying drawing, in which.

Figure 1:
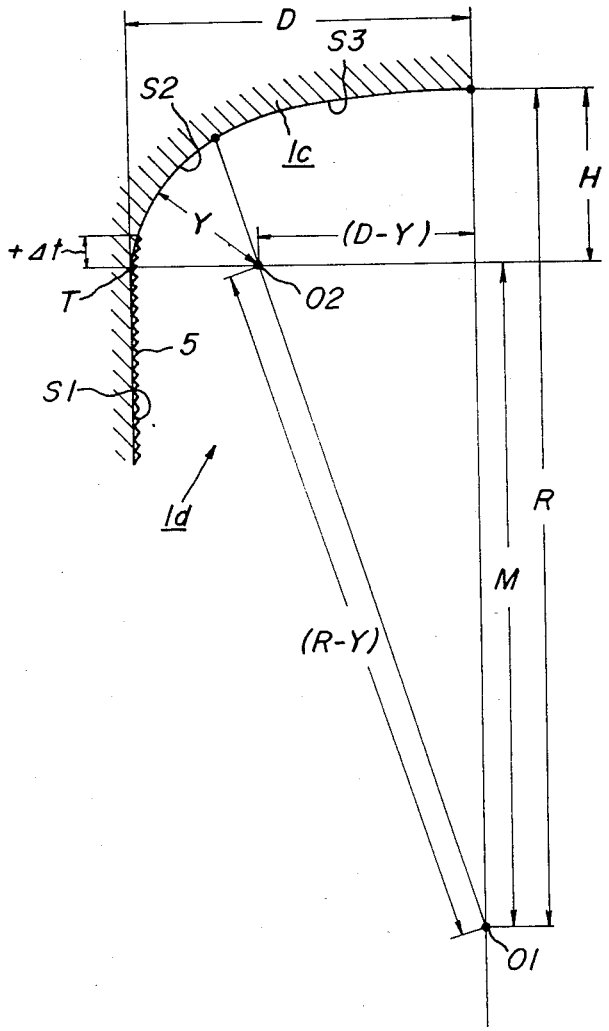
FIG. 1 is a diagrammatic illustration of the upper corner portion of a pin hole in a porcelain insulating member head portion, in which sands are rigidly deposited on a cylindrical surface portion to the lower portion of the corner portion.

Throughout different views of the drawing, the following symbols are used.

1: an insulating member,
1*a*: a shed,
1*b*: an under-rib,
1*c*: a head portion,
1*d*: a pin hole,
2, 2*a*: cement,
3: a metal cap,
3*a*: a socket,
4: a metal pin,
5: sands,
6: a cork,
S1: a cylindrical surface portion,
S2: a round corner surface,
S3: a curved top surface,
T: boundary between the cylindrical surface portion S1 and the round corner surface S2,
Δt: a distance from the top of the area with sands 5 to the boundary T between the cylindrical surface portion S1 and the round corner surface S2.

DESCRIPTION OF THE PREFERRED EMBODIMENT

An embodiment of the suspension insulator of the invention will be described now by referring to FIG. 1 through FIG. 4.

Figure 4:
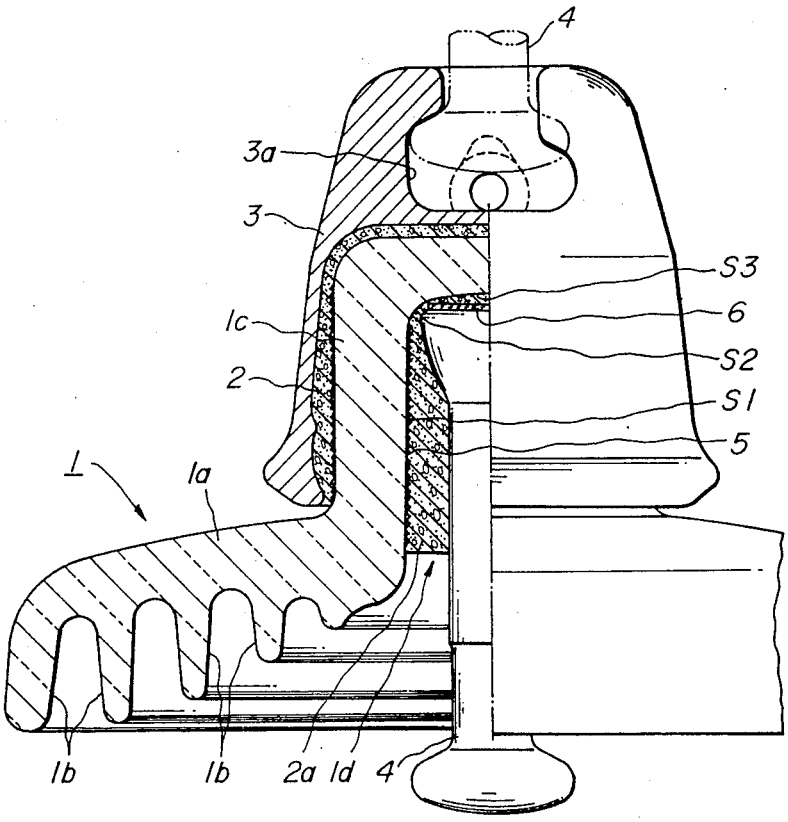
FIG. 4 is a partially cutaway side view of a suspension insulator according to the invention.
Figure 5:
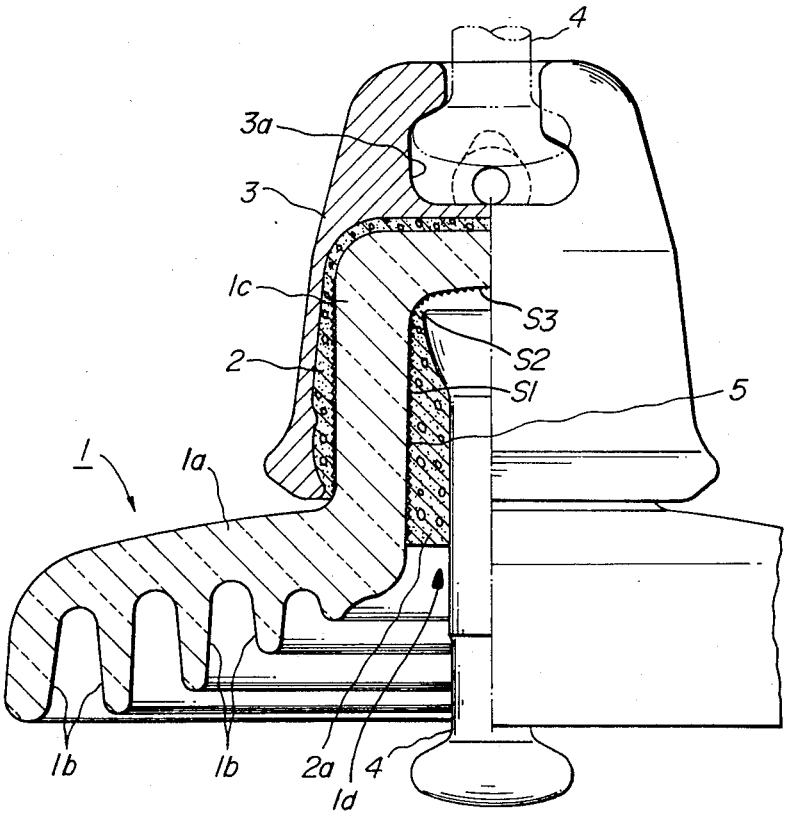
FIG. 5 PRIOR ART
FIG. 5 is a partially cutaway side view of a conventional suspension insulator.

An insulating member 1 of the suspension insulator of FIG. 4 is an integral porcelain body having a shed 1*a* radially extending from a head portion 1*c*, and a plurality of annular under-ribs 1*b* are formed on the inner surface of the shed 1*a* in a concentric manner with a center at the head portion 1*c*. A metal cap 3 is secured to the closed top portion of the head portion 1c by cement 2 so as to cover the outer surface of the head portion 1c. A socket 3a is formed on the top portion of the metal cap 3, and the lower end of a metal pin 4 of another suspension insulator immediately above can be inserted into the socket 3a as shown by dot-dot-dash line in the figure, so as to connect the two insulators. The upper end of each metal pin 4 is firmly joined to the inside of the head portion 1c of the insulating member 1 of the suspension insulator by cement 2a. The lower end of each metal pin 4 is engageable with the socket 3a of a metal cap 3 of another suspension insulator immediately below in the same manner as described above.

The inside space of the head portion 1c is a pin hole 1d for holding the pin 4. With the present invention, sands 5 are rigidly deposited only at a part of the inside surface of the pin hole 1d, but the part with the sands 5 is large enough to ensure a strong mechanical joint between the head portion 1c and the metal pin 4. A cork 6 is disposed on the top surface of the metal pin 4, so as to absorb thermal expansion and contraction of the metal pin 4.

As shown in FIG. 1 and FIG. 4, the pin hole 1d has a cylindrical surface portion S1 with a radius D, a round corner surface S2 with a radius of curvature Y which surface S2 is continuous to the upper end of the cylindrical surface portion S1, and a curved top surface S3 whose periphery is smoothly connected to the upper end of the round corner surface S2. In the illustrated embodiment, the cross-section of the round corner surface S2 represent about one quarter of a circle, and the curved top surface S3 is a part of the sphere with a radius R. The radius R is larger than the radius of curvature Y of the round corner surface S2. In the example of FIG. 1, the upper end of the area with sands 5 extends by a distance Δt above the boundary T between the cylindrical surface portion S1 and the round corner surface S2. In the present invention, this distance Δt must be in a range of ±3 mm relative to the above mentioned boundary T because of the reasons to be described hereinafter.

In the example of FIG. 1, the distance between the center of curvature $O_1$ of the curved top surface S3 and the center of curvature $O_2$ of the round corner surface S2 is (R−Y), and the horizontal spacing between the centers of curvature $O_1$ and $O_2$ is (D−Y). Thus, the vertical spacing M between the centers of curvature $O_1$ and $O_2$ is given by $$M = \sqrt{(R - D)(R + D - 2Y)}$$

Accordingly, the vertical distance H between the zenith of the curved top surface S3 and the upper end T of the cylindrical surface portion (with a central axis passing through the above-mentioned center $O_1$) is given by $$H = R - \sqrt{(R - D)(R + D - 2Y)}$$

The inventors prepared test specimens of the suspension insulators of various sizes with different dimensions, and measured their electric and mechanical characteristics. As a result, the inventors have found that the relationship of the following Table 1 is desirable for reliable electrical and mechanical characteristics of the suspension insulators. The symbols used in Table 1 are as follows: namely, Δt: a distance from the top of the area with sands 5 to the boundary T between the cylindrical surface portion S1 and the round corner surface S2.

Y/D: a ratio between the radius of curvature Y of the round corner surface S2 and the radius D of the cylindrical surface portion S1.

Insulator size: size of suspension insulator in terms of the class of rated value of the electromechanical failing load in tons.

TABLE 1

| Insulator size (Rated M & E Strength) | Distance Δt (mm) | Y/D ratio |
|---|---|---|
| 7 | −1.7 | 0.4 |
| 12 | −0.5 | 0.37 |
| 16 | −0.4 | 0.35 |
| 21 | +1.5 | 0.42 |
| 30 | −0.7 | 0.35 |

As can be seen from Table 1, the Y/D ratio falls in a range of 0.35 to 0.42. More particularly, if the Y/D ratio is less than 0.3, an excessive concentration of electric field may occur. On the other hand, if the Y/D ratio is larger than 0.45, extra care is necessary in positioning the metal pin 4 and the suspension insulator tends to become too large in size.

Figure 2:
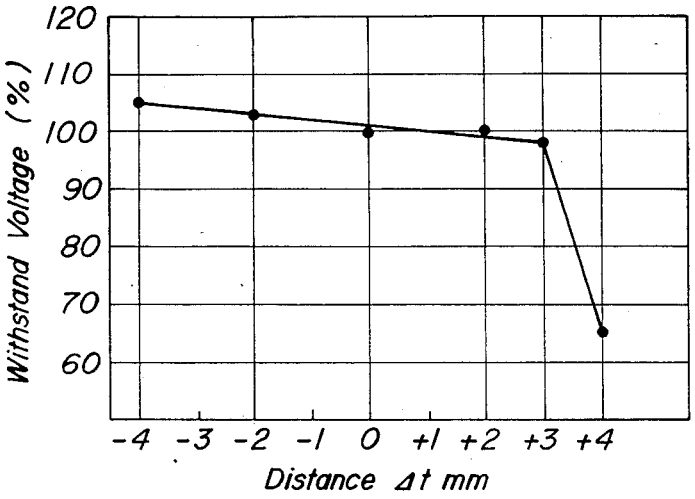
FIG. 2 is a graph showing the relation between the electric withstand voltage of the insulator and the distance Δt from the top of the area with sands to the boundary T between the cylindrical surface portion and the round corner surface.

FIG. 2 shows the result of electric withstand voltage tests on the suspension insulators of 12 ton M & E strength, of various dimensions. As can be seen from the figure, if the distance Δt from the top of the area with sands 5 to the boundary T between the cylindrical surface portion S1 and the round conner surface S2 exceeds +3 mm, the withstand voltage drops rapidly, so that this distance Δt must be less than 3 mm.

Figure 3:
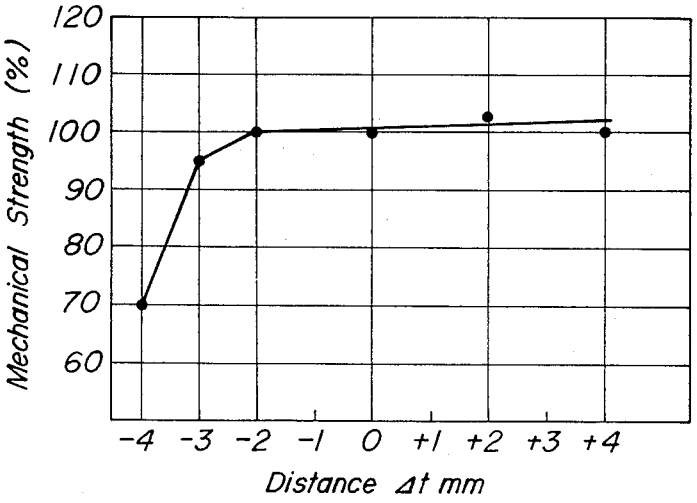
FIG. 3 is a similar graph showing the relation between the mechanical strength of the insulator and the above defined distance Δt.

FIG. 3 shows the result of tensile strength tests under similar conditions as the tests of FIG. 2. As can be seen from FIG. 3, if the distance Δt from the top of the area with sands 5 to the boundary T between the cylindrical surface portion S1 and the round corner surface S2 exceeds −3 mm, or if the top of the sands 5 is below the boundary T by more than 3 mm, the mechanical strength decreases rapidly, so that this distance Δt must be larger than −3 mm, namely the absolute value of the distance Δt must be less than 3 mm.

As described in detail in the foregoing, with the suspension insulator of the invention, excessive concentration of the electric field at the round corner surface of the pin hole in the head portion is greatly reduced while a high mechanical bondage of the metal pin with the head portion is ensured by a sufficient amount of sands deposited on the inside surface of the pin hole. Whereby, an outstanding effect of simultaneously achieving both excellent electric characteristics and excellent mechanical characteristics is fulfilled.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A suspension insulator, comprising:

a porcelain insulating member including a head portion and a shed portion extending radially from said head portion, said head portion having an inner pin hole with a closed top and an open bottom, said pin hole having an inside surface including a cylindrical surface portion adjacent said open bottom, a curved top surface portion facing said open bottom and a round corner surface portion forming a smooth boundary between said cylindrical surface portion and said curved top surface portion, said cylindrical surface portion having a radius equal to D and said round corner surface portion having a radius of curvature equal to Y, such that a ratio of Y/D is in the range of 0.3–0.45;

a metal cap cemented to the outer surface of said head portion; and a metal pin cemented within said pin hole of said head portion, said inside surface of said pin hole including a cemented portion which has sands rigidly deposited thereon over a range extending from a bottom of said cemented portion adjacent said open bottom, to a level within ±3 mm of a junction between said cylindrical surface portion and said round corner surface portion.

* * * * *